US006511105B1

(12) United States Patent
Sakamoto

(10) Patent No.: US 6,511,105 B1
(45) Date of Patent: Jan. 28, 2003

(54) LOCKING DEVICE

(75) Inventor: Yutaka Sakamoto, Hiroshima (JP)

(73) Assignee: Delta Tooling Co., Ltd., Hiroshima (JP)

( * ) Notice: Subject to any disclaimer, the term of this patent is extended or adjusted under 35 U.S.C. 154(b) by 0 days.

(21) Appl. No.: 09/521,206

(22) Filed: Mar. 8, 2000

(30) Foreign Application Priority Data

Mar. 10, 1999 (JP) ..... 11-060371
Nov. 5, 1999 (JP) ..... 11-315067

(51) Int. Cl.[7] ..... E05C 5/00

(52) U.S. Cl. ..... 292/113; 292/92; 292/48; 292/DIG. 31

(58) Field of Search ..... 292/DIG. 5, DIG. 31, 292/DIG. 49, 92, 98, 113, 48, 247; 403/93, 94; 137/103, 89; 251/111, 103, 109; 5/86.1

(56) References Cited

U.S. PATENT DOCUMENTS 1,049,662 A * 1/1913 Brown et al. ..... 251/109
3,647,251 A * 3/1972 Brown et al. ..... 292/111
4,077,601 A * 3/1978 Dick ..... 251/9
4,736,959 A * 4/1988 Van Steenburg ..... 280/30
4,909,275 A * 3/1990 Massey et al. ..... 137/385
5,052,655 A * 10/1991 Ackroyd ..... 251/95
5,501,283 A * 3/1996 Nordquist ..... 172/22
5,586,604 A * 12/1996 Postema ..... 172/21
5,785,362 A * 7/1998 Nadhrny ..... 292/98
5,806,111 A * 9/1998 Heimbrock et al. ..... 5/86.1
6,125,485 A * 10/2000 Way et al. ..... 5/600

* cited by examiner

*Primary Examiner*—Anthony Knight
*Assistant Examiner*—André L. Jackson
(74) *Attorney, Agent, or Firm*—Wenderoth, Lind & Ponack, L.L.P.

(57) ABSTRACT

A locking device is to be mounted on a bed of a truck or within an ambulance to lock or fasten goods on the bed or a stretcher within the ambulance. The locking device includes a frame, an operating handle rotatably mounted on the frame, a link mechanism connected to the operating handle and having a recess defined therein, a hook connected to the operating handle via the link mechanism, and a locking pin slidable relative to the operating handle. The hook is locked by introducing the locking pin into the recess and is unlocked by moving the locking pin apart from the recess.

20 Claims, 15 Drawing Sheets

LOCKING DEVICE

BACKGROUND OF THE INVENTION

1. Field of the Invention

The present invention relates to a locking device mounted on a bed of a truck or within an ambulance that carries sick or wounded people, and locks or fastens goods on the bed or a stretcher within the ambulance.

2. Description of the Related Art

The stretcher is generally used to transfer a sick or wounded person to the inside of an ambulance. After having been transferred into the ambulance, the stretcher is usually placed on a vibration isolator or the like and is then locked or fastened thereto by a locking device.

A ratchet mechanism is generally employed in the conventional locking devices for the stretchers. When the stretcher is locked, a hook is first raised and advanced, and is then locked by the ratchet mechanism. Conversely, when the stretcher is unlocked, a pawl is first released and the hook is then backed. Accordingly, the use of both hands is inevitably required, and not only is the operation troublesome, but also the locking and the unlocking can not be carried out rapidly.

Furthermore, although various locking devices for locking goods on the bed of a truck have been proposed up to this time, many of them have only a small versatility or flexibility and, hence, cannot be used to lock the stretcher or other machines or apparatuses.

SUMMARY OF THE INVENTION

The present invention has been developed to overcome the above-described disadvantages.

It is accordingly an objective of the present invention to provide a reliable general-purpose locking device whereby locking and unlocking can be readily and rapidly performed using only one hand.

In accomplishing the above and other objectives, the locking device according to the present invention includes a frame, an operating handle rotatably mounted on the frame, a link mechanism connected to the operating handle and having a recess defined therein, a hook connected to the operating handle via the link mechanism, and a locking pin slidable relative to the operating handle. With this arrangement, the hook is locked by introducing the locking pin into the recess and is unlocked by moving the locking pin apart from the recess, making it possible to perform locking and unlocking rapidly with simple operation.

Advantageously, the locking device further includes a lock releasing handle slidable relative to the operating handle, wherein the locking pin is secured to the lock releasing handle. By this construction, the locking and unlocking can be readily performed using only one hand.

Conveniently, the operating handle and the lock releasing handle have respective grips disposed adjacent and extending substantially parallel to each other. By this construction, the locking can be rapidly released merely by grasping both the grips.

Preferably, the locking device further includes an elastic member for biasing the lock releasing handle. The hook is locked by the elastic member that biases the lock releasing handle in a direction in which the grip of the lock releasing handle is moved away from the grip of the operating handle, while the hook is unlocked by moving the grip of the lock releasing handle towards the grip of the operating handle against an elastic force of the elastic member. By so doing, not only can the hook be rapidly released merely by grasping both the grips, but the hook can also be readily locked by means of the biasing force of the elastic member when the user takes his hand off the grips.

The locking device according to the present invention is mounted on, for example, a vibration isolator for a stretcher. In this case, the position of the locking device can be adjusted in a direction longitudinally of the vibration isolator, making it possible to absorb variations in the vibration isolator and to provide a reliable locking device.

In another form of the present invention, a locking device includes a frame, an operating handle rotatably mounted on the frame, a link mechanism connected to the operating handle, a hook connected to the operating handle via the link mechanism and being movable between a locking position and a lock-released position, and an eccentric cam connected to the link mechanism. A center of rotation of the hook at the locking position is moved below the center of rotation of the hook at the lock-released position by rotating the eccentric cam via the link mechanism, making it possible to positively perform the locking.

Advantageously, the locking device further includes a rocking shaft connected to the operating handle via the link mechanism. The hook has an elongated opening defined therein in which the rocking shaft is loosely inserted. By this construction, the hook can be rapidly moved towards the locking position.

The locking device further includes a locking pin slidable relative to the operating handle. The link mechanism includes an arm having a recess defined therein, and the hook is locked by introducing the locking pin into the recess and is unlocked by moving the locking pin apart from the recess, making it possible to perform locking and unlocking rapidly with simple operation.

The locking device also includes an elastic member connected to the hook. An elastic force of the elastic member acts on the hook in a first direction when the hook is at the locking position, while the elastic force of the elastic member acts on the hook in a second direction counter to the first direction when the hook is at the lock-released position. By so doing, not only can the locking and unlocking be performed rapidly, but the hook can also be positively held at the locking position or at the lock-released position.

BRIEF DESCRIPTION OF THE DRAWINGS

The above and other objectives and features of the present invention will become more apparent from the following description of preferred embodiments thereof with reference to the accompanying drawings, throughout which like parts are designated by like reference numerals, and wherein.

DETAILED DESCRIPTION OF THE PREFERRED EMBODIMENTS

This application is based on applications Nos. 11-63071 and 11-315067 filed Mar. 10,1999 and Nov. 5, 1999 in Japan, respectively, the content of which is incorporated hereinto by reference.

Several locking devices according to the present invention are discussed hereinafter with reference to the drawings, in an environment in which each locking device is mounted within an ambulance to lock a stretcher that carries a sick or wounded person.

Figure 1:
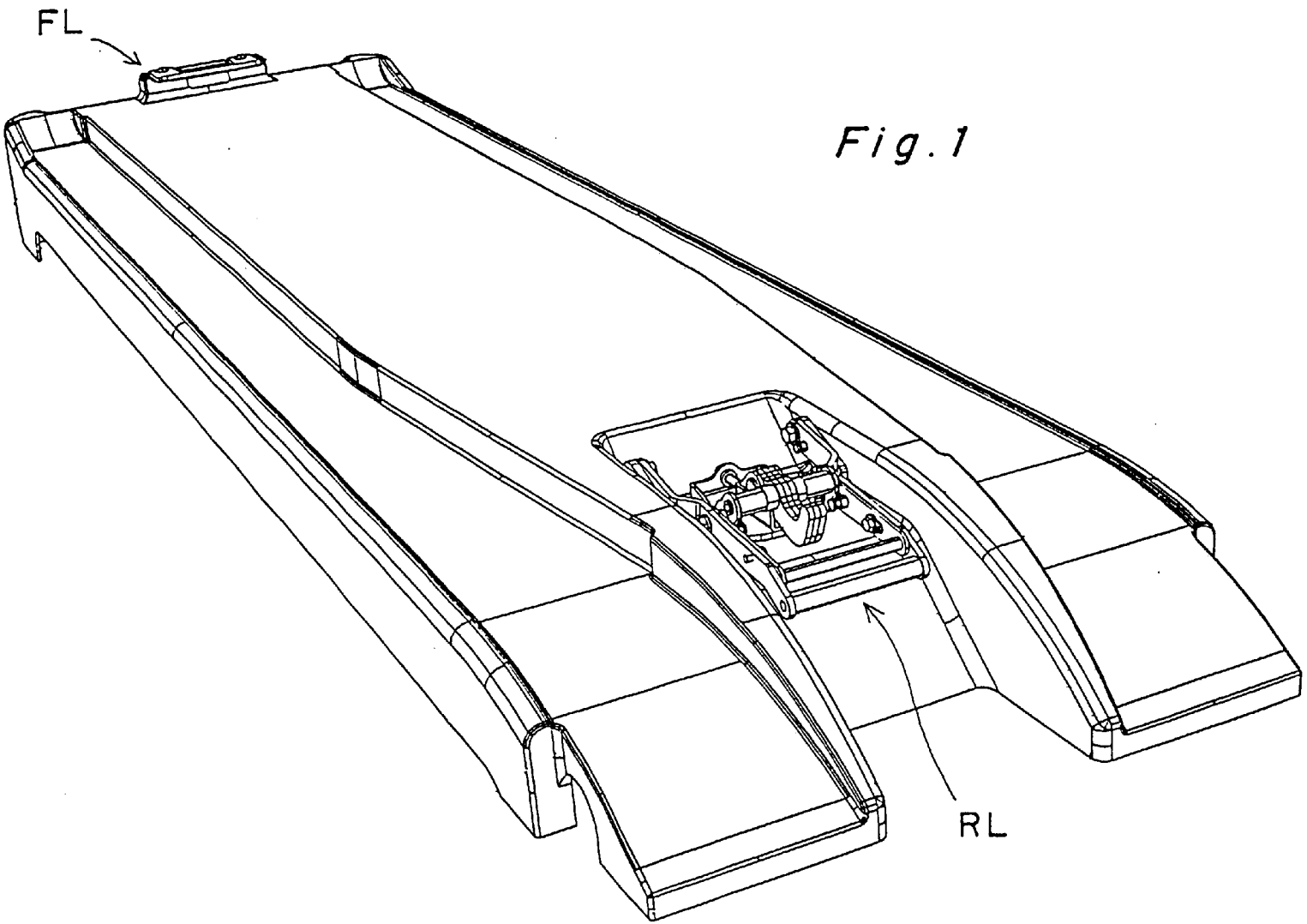
FIG. 1 is a perspective view of a vibration isolator for a stretcher to which a locking device according to the present invention is applied, particularly depicting the lock-released condition.
Figure 2:
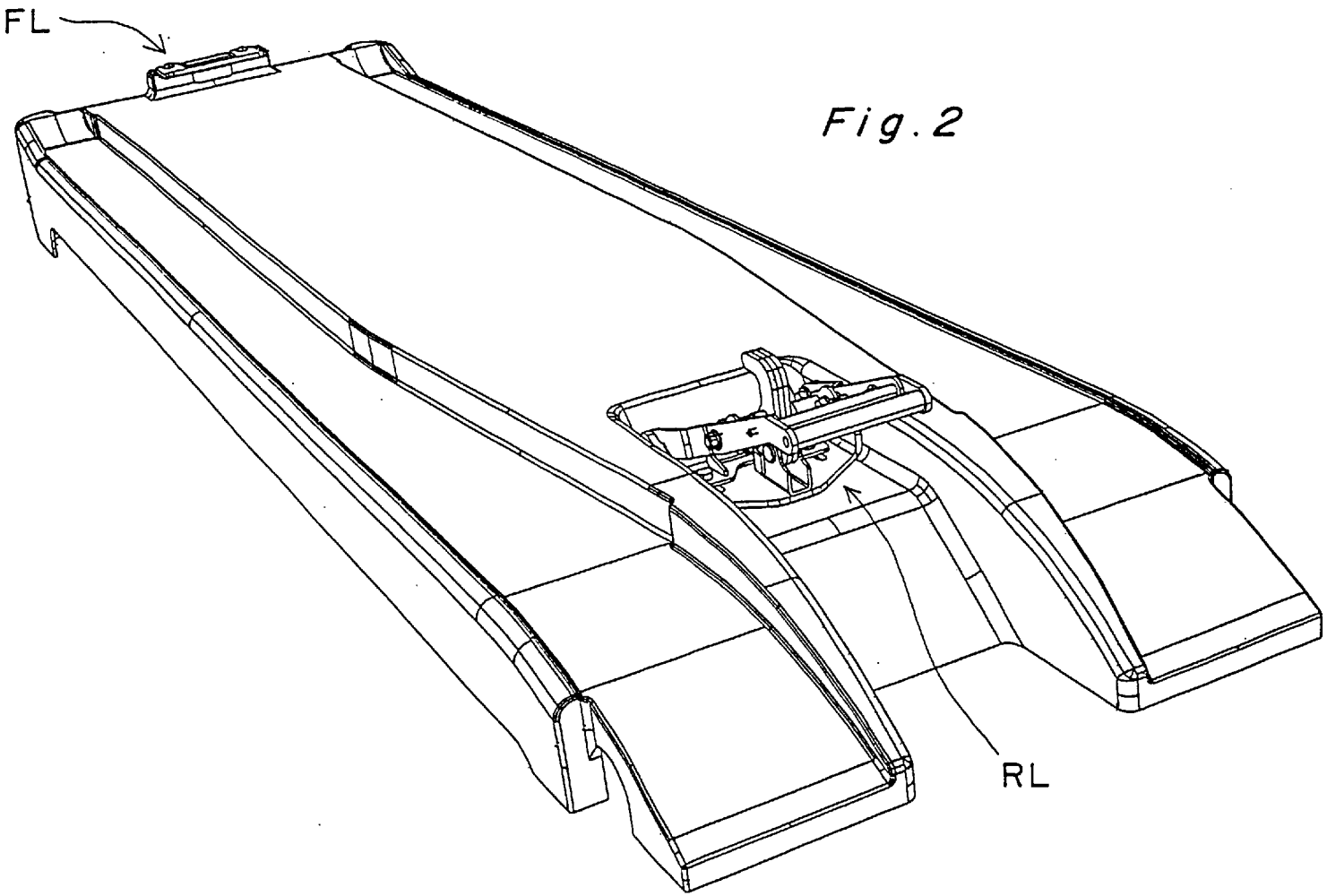
FIG. 2 is a view similar to FIG. 1, but depicting the locked condition.

FIGS. 1 and 2 depict a vibration isolator for the stretcher. This vibration isolator is used to support thereon the stretcher, on which a sick or wounded person is placed, to absorb vibration inputted to the stretcher, thereby lightening a burden applied to the sick or wounded person on the stretcher.

As shown in FIGS. 1 and 2, the vibration isolator includes a front locking device FL and a rear locking device RL. Under the unlocked condition shown in FIG. 1, the sick or wounded person together with the stretcher is placed on the vibration isolator, nd the stretcher is then locked or fastened to the vibration isolator by the front locking device FL and the rear locking device RL, as shown in FIG. 2.

The locking device according to the present invention is used, for example, as the rear locking device RL referred to above.

FIGS. 3 to 7 depict a locking device L according to a first embodiment of the present invention, which includes a frame 2 mounted on the vibration isolator, a pair of mounts 4, 4 disposed on respective sides of the frame 2, a generally U-shaped operating handle 6 rotatably mounted on the mounts 4, 4, and a hook 8 for locking the stretcher.

The hook 8 is rotatably mounted, via a rotary shaft 12, on a bracket 10 slidably mounted on the frame 2, and has a locking shaft 14 extending therethrough at an intermediate portion thereof. The bracket 10 is connected to one end of an adjusting bolt 16, the other end of which is fastened, by a nut 20, to a fastening member 18 attached to the vibration isolator.

The rocking shaft 14 is rotatably mounted by connecting opposite ends thereof to first ends of two arms 24, 24, and the second ends of arms 24, 24 are rotatably mounted on the operating handle 6 via respective pins 26, 26. Each of the arms 24, 24 has a recess 24*a* defined therein at an outer periphery thereof close to the associated pin 26 so that a locking pin (described later) may be received in the recess 24*a* during locking.

A generally U-shaped lock releasing handle 28 is disposed inside the operating handle 6 and has two elongated openings (not shown) defined therein in which t e pins 26, 26 are loosely inserted, respectively. The lock releasing handle 28 also has two locking pins 30, 30 secured thereto at locations close to the elongated opening so as to protrude laterally inwardly therefrom. The lock releasing handle 28 further has two elongated openings 32, 32 defined therein, in which pins 34, 34 are loosely inserted, respectively, to allow a sliding movement of the lock releasing handle 28 relative to the operating handle 6.

A grip 28*a* of the lock releasing handle 28 is positioned adjacent to a grip 6*a* of the operating handle 6 and extends substantially parallel thereto. Opposite ends (lower ends) of the lock releasing handle 28 are connected to ends of coil springs 36, 36, the other ends of which are connected to pins 38, 38 secured to lower ends of he operating handle 6, respectively.

The locking device L of the above-described construction operates as follows.

When the locking of the stretcher is released, as shown in FIG. 1, the whole locking device L (RL) is positioned below the upper surface of the vibration isolator so as not to impede loading or unloading of the stretcher.

Figure 3:
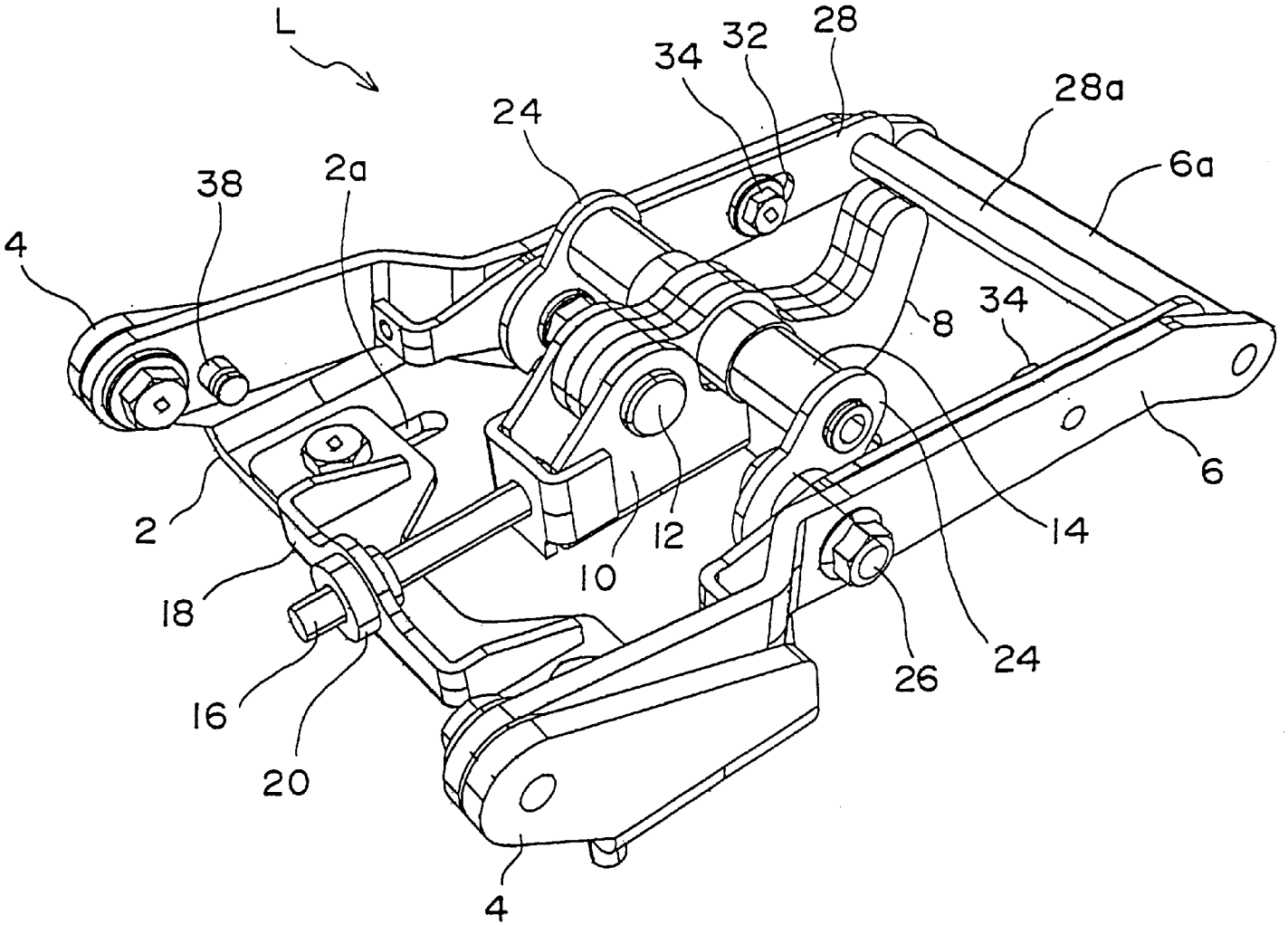
FIG. 3 is a perspective view of a locking device according to a first embodiment of the present invention under the lock-released condition.
Figure 4:
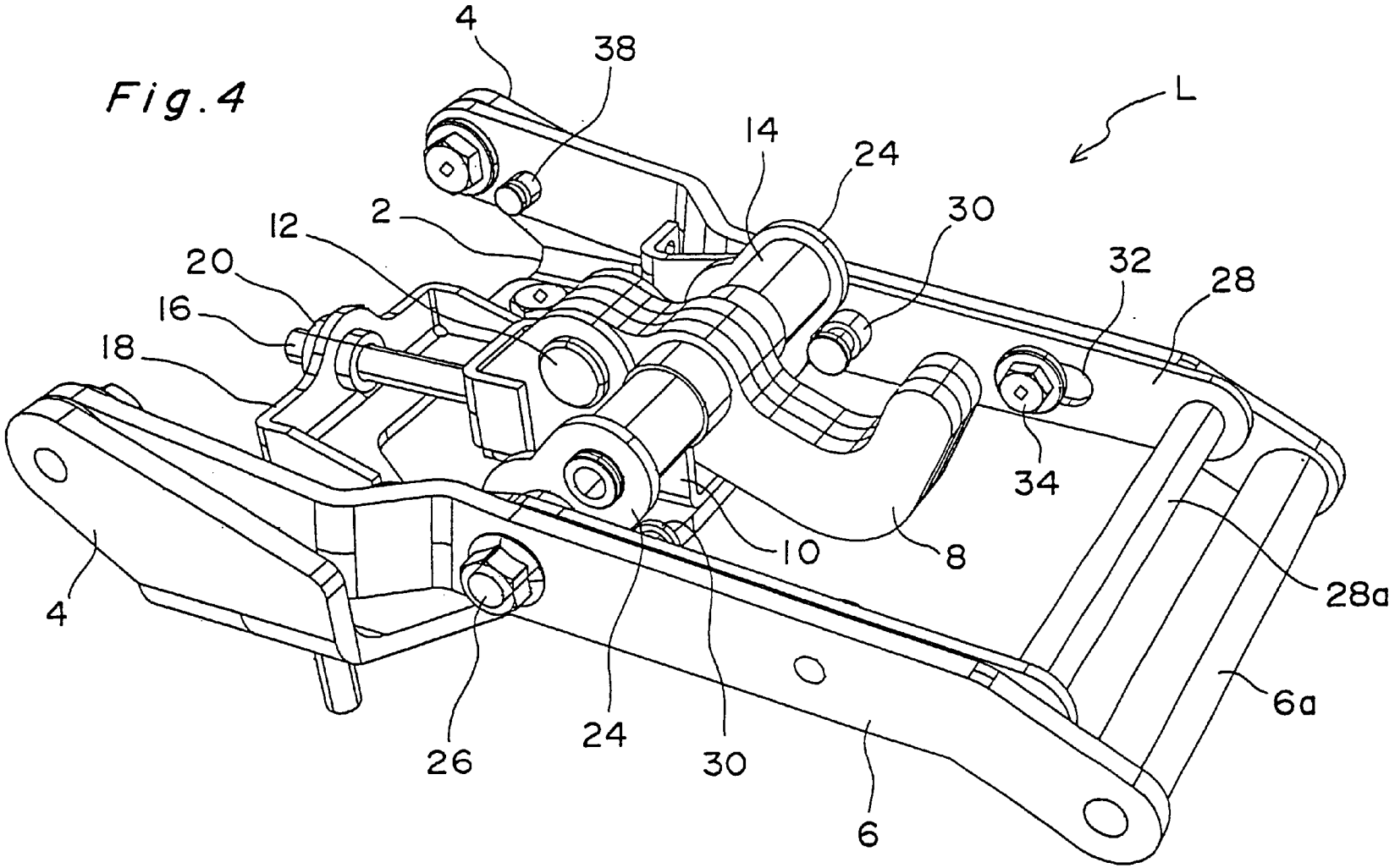
FIG. 4 is another perspective view of the locking device of FIG. 3.

Under the lock-released condition, the operating handle 6 is kept depressed together with the lock releasing handle 28, and the grip 28*a* of the lock releasing handle 28 is located at a position closest to the grip 6*a* of the operating handle 6, as shown in FIGS. 3 and 4. At this moment, the hook 8 is held substantially horizontally by the link mechanism including the arms 24, 24 and the like, and the arms 24, 24 are held in contact at side portions thereof with the locking pins 30, 30, respectively.

Figure 5:
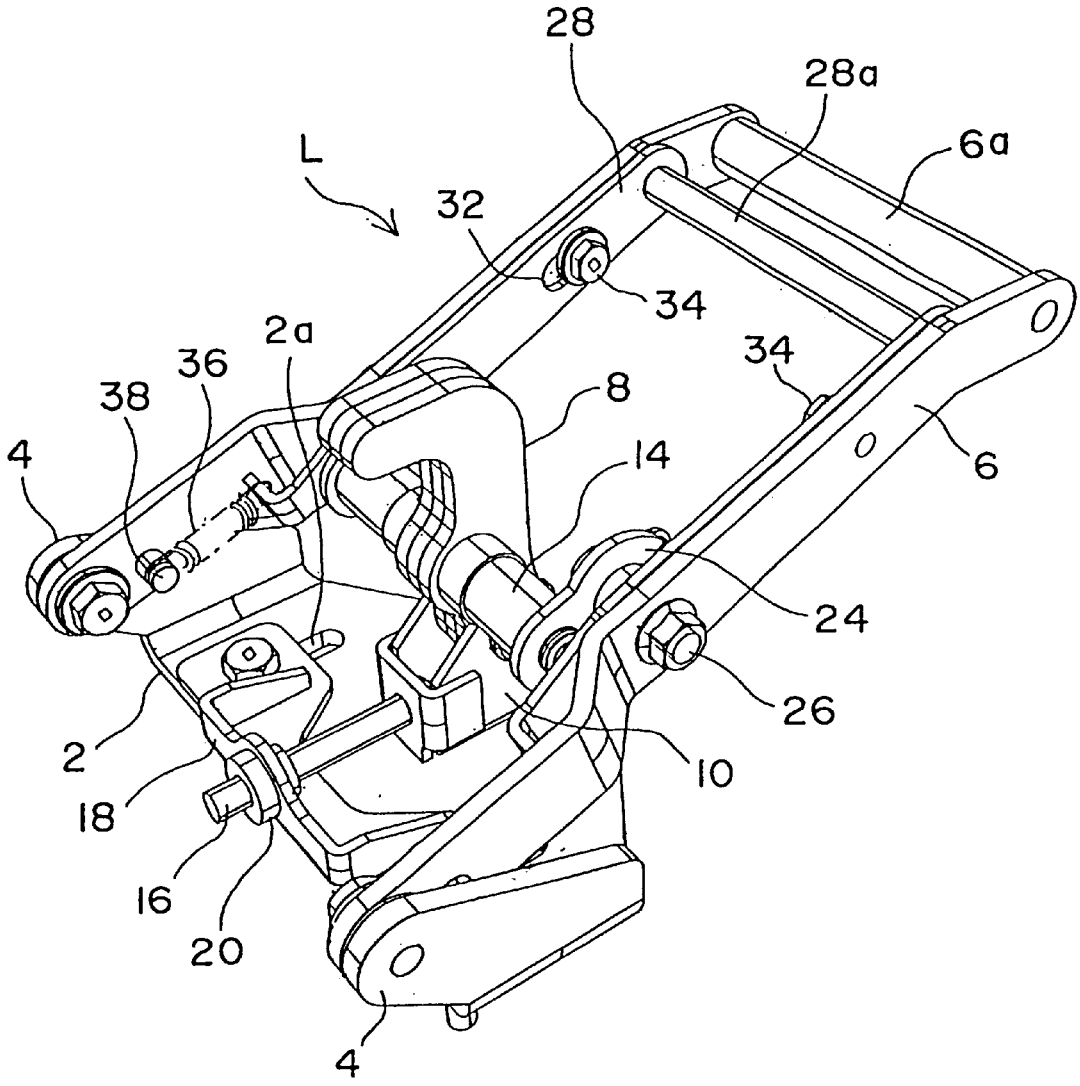
FIG. 5 is a perspective view of the locking device under the locked condition.
Figure 6:
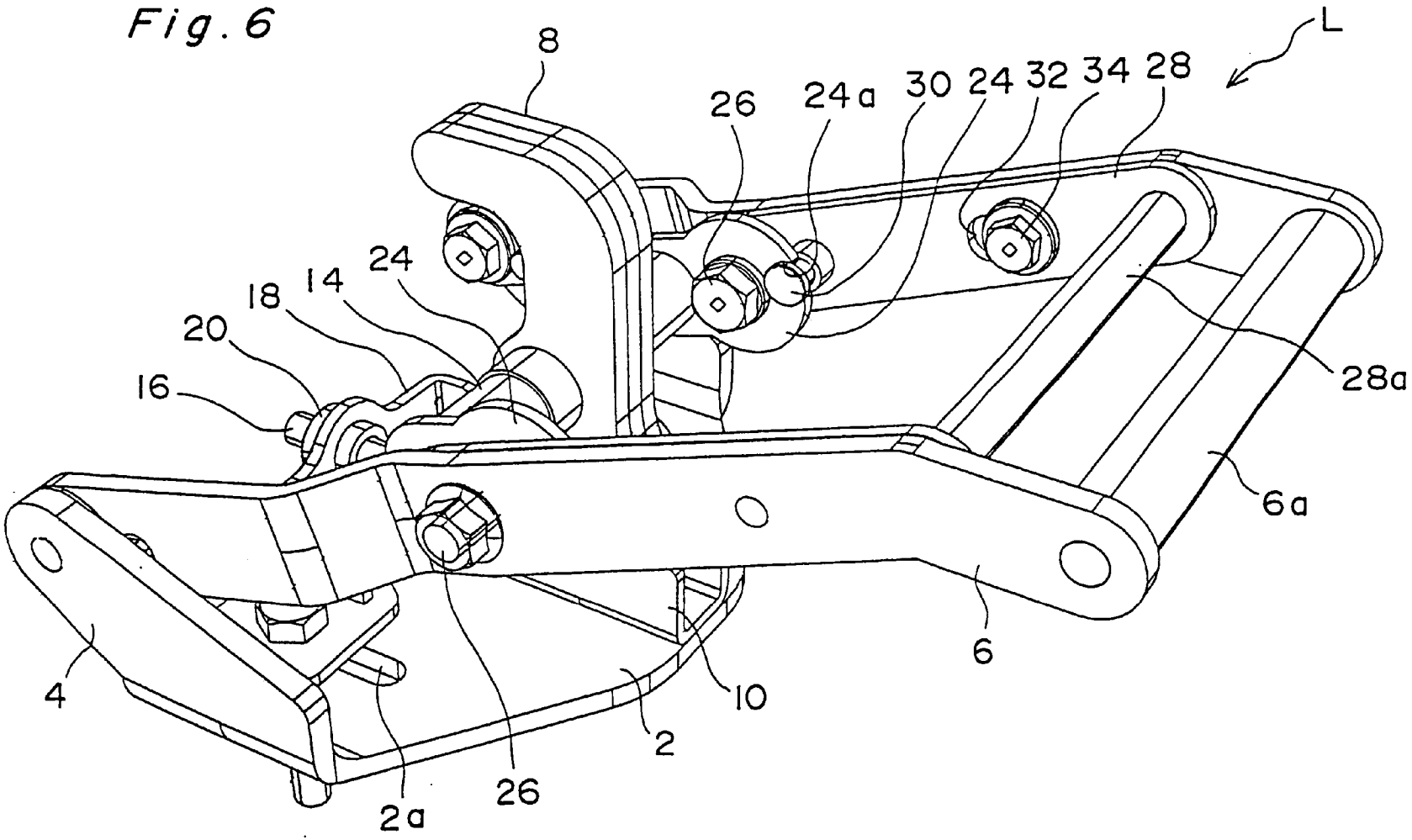
FIG. 6 is another perspective view of the locking device of FIG. 5.
Figure 7:
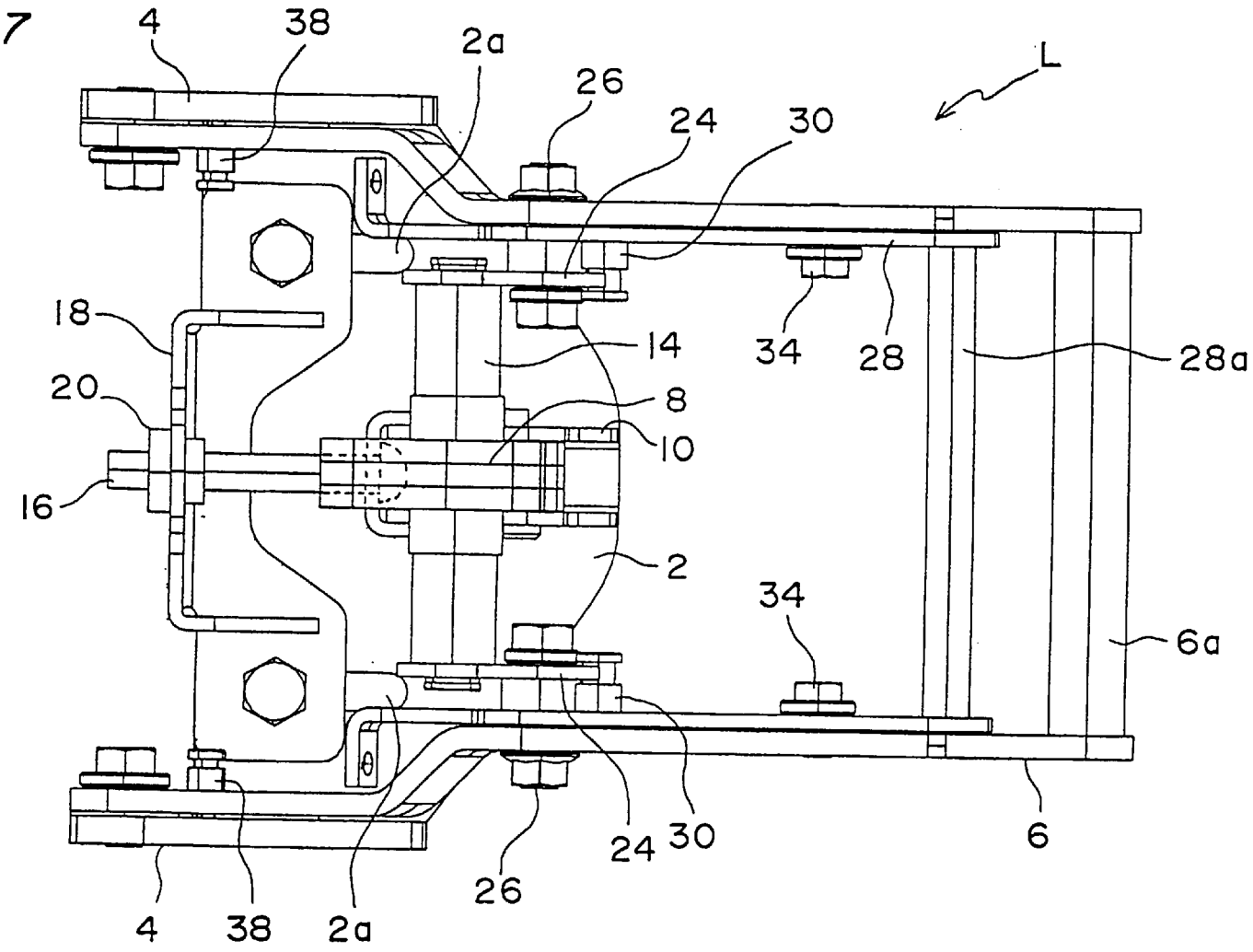
FIG. 7 is a top plan view of the locking device of FIG. 5.

When the stretcher is locked after the stretcher together with a sick or wounded person has been led in the ambulance and placed on the vibration isolator, the grip 6*a* of the operating handle 6 is lifted, as shown in FIGS. 5 to 7. At this moment, the lock leasing handle 28 is lifted together with the operating handle 6, and the arms 24, 24 are pushed by the associated locking pins 30, 30. As a result, the locking shaft 14 extending through the hook 8 at an intermediate portion thereof is moved frontwards and, hence, the hook 8 is rotated about the rotary shaft 12 towards the locking position (erected position).

When the hook 8 has reached the locking position, the locking pins 30, 30 are received in the recesses 24*a*, 24*a* formed in the arms 24, 24 at the ends thereof close to the pins 26, 26, respectively. At this moment, the lock releasing handle 28 is moved away from the grip 6*a* of the operating handle 6 by means of the biasing forces of the coil springs 36, 36, and is held at the position farthest from the grip 6*a* of the operating handle 6.

At the locking position, the stretcher is locked or fastened by the hook 8, and the locking pins 30, 30 received in the associated recesses 24*a*, 24*a* of the arms 24, 24 prevent the hook from being released, even if external vibration is inputted.

When the hook of the stretcher is released, the grip 6*a* of the operating handle 6 and the grip 28*a* of the lock releasing handle 28 are both grasped to bring the grip 28*a* near the grip 6*a* against the biasing forces of the coil springs 36, 36, thereby moving the locking pins 30, 30 apart from the associated recesses 24*a*, 24*a* of the arms 24, 24. Thereafter, when the operating handle 6 and the lock releasing handle 28 are moved downwards, the hook 8 is rotated about the rotary shaft 12 via the link mechanism until it reaches the lock-released position shown in FIGS. 3 and 4.

Because the above-described locking device L is attached to the vibration isolator by bolts extending through the elongated openings 2*a*, 2*a* in the frame 2 and is positioned by the fastening member 18 with the nut 20 and the adjusting bolt 16 threaded to the nut 20, the longitudinal position of the locking device L relative to the vibration isolator can be properly adjusted by rotating the adjusting bolt 16, making it possible to absorb variations in the vibration isolator and to positively lock the stretcher.

It is to be noted that although in the above-described embodiment the lock releasing handle 28 has been described as being biased towards the locking position by the tension springs 36, 36, compression springs may be disposed, in place of the tension springs 36, 36, between the grip 6*a* of the operating handle 6 and the grip 28*a* of the lock releasing handle 28.

FIGS. 8 to 15 depict a locking device L according to a second embodiment of the present invention, which includes a frame 102 mounted on the vibration isolator, a pair of generally parallel mounts 104, 104 secured to the frame 102 at a central portion thereof, a generally U-shaped operating handle 106 rotatably mounted on the mounts 104, 104 via a rotary shaft 105, and a hook 108 for locking the stretcher.

The hook 108 is rotatably mounted, via an eccentric cam 112, on a bracket 110 threaded to the mounts 104, 104, and has an elongated opening 108*a* defined therein at an intermediate portion thereof A locking shaft 114 is loosely inserted in the elongated opening 108*a*, and is pivotally connected at opposite ends thereof to ends of first arms 116, 116. The other ends of the first arms 116, 116 together with ends of second arms 18, 118 are pivotally connected to the operating handle 106 by means of mounting bolts 119, 119, respectively. The other ends of the second arms 118, 118 are pivotally connected to ends of third arms 120, 120, the other ends of which are fixed to a connecting shaft 122 connected to the eccentric cam 112 .

Each of the first arms 116, 116 has a recess 116*a* defined therein at an outer periphery thereof close to the associated mounting bolt 119 so that a locking pin (described later) may be received in the recess 116*a* during locking.

The hook 108 has a spring holder 124 secured thereto at a location close to the eccentric cam 112. A torsion spring 126 is connected at one end thereof to the spring holder 124 and at the other end thereof to the frame 102. The torsion spring 126 biases the hook 108 at the lock-released position in the direction of an arrow A and also biases the hook 108 at the locked position in the direction counter to the direction of the arrow A.

A generally U-shaped lock releasing handle 132 is disposed inside the operating handle 106 and has two elongated openings (not shown) defined therein in which the mounting bolts 119, 119 are loosely inserted, respectively. The lock releasing handle 132 also has two locking pins 134, 134 secured thereto at locations close to the elongated openings so as to protrude laterally inwardly therefrom. The lock releasing handle 132 further has two elongated openings 132*a*, 132*a* defined therein, in which pins 136, 136 are loosely inserted, respectively, to allow a sliding movement of the lock releasing handle 132 relative to the operating handle 106.

The first arms 116, 116 are appropriately spaced from the lock releasing handle 132 via spacers 128, 128 and from the hook 108 via spacers 130, 130.

A grip 132*b* of the lock releasing handle 132 is positioned close to a grip 106*a* of the operating handle 106 and extends substantially parallel thereto. Opposite ends (lower ends) 132*c*, 132*c* of the lock releasing handle 132 are connected to ends of coil springs (not shown), the other ends of which are connected to pins 138, 138 secured to lower ends of the operating handle 106, respectively.

Two adjusting bolts 140, 140 are mounted on the frame 102 on respective sides thereof, and two elongated openings 102*a*, 102*a* are formed in the frame 102 inside the adjusting bolts 140, 140 so as to extend substantially parallel thereto. A fastening bolt 142 loosely inserted in each of the elongated openings 102*a*, 102*a* is held by a mounting tab 144, to which an associated one of the adjusting bolts 140, 140 is threaded.

The operation of the locking device L of the above-described construction is discussed hereinafter.

Figure 8:
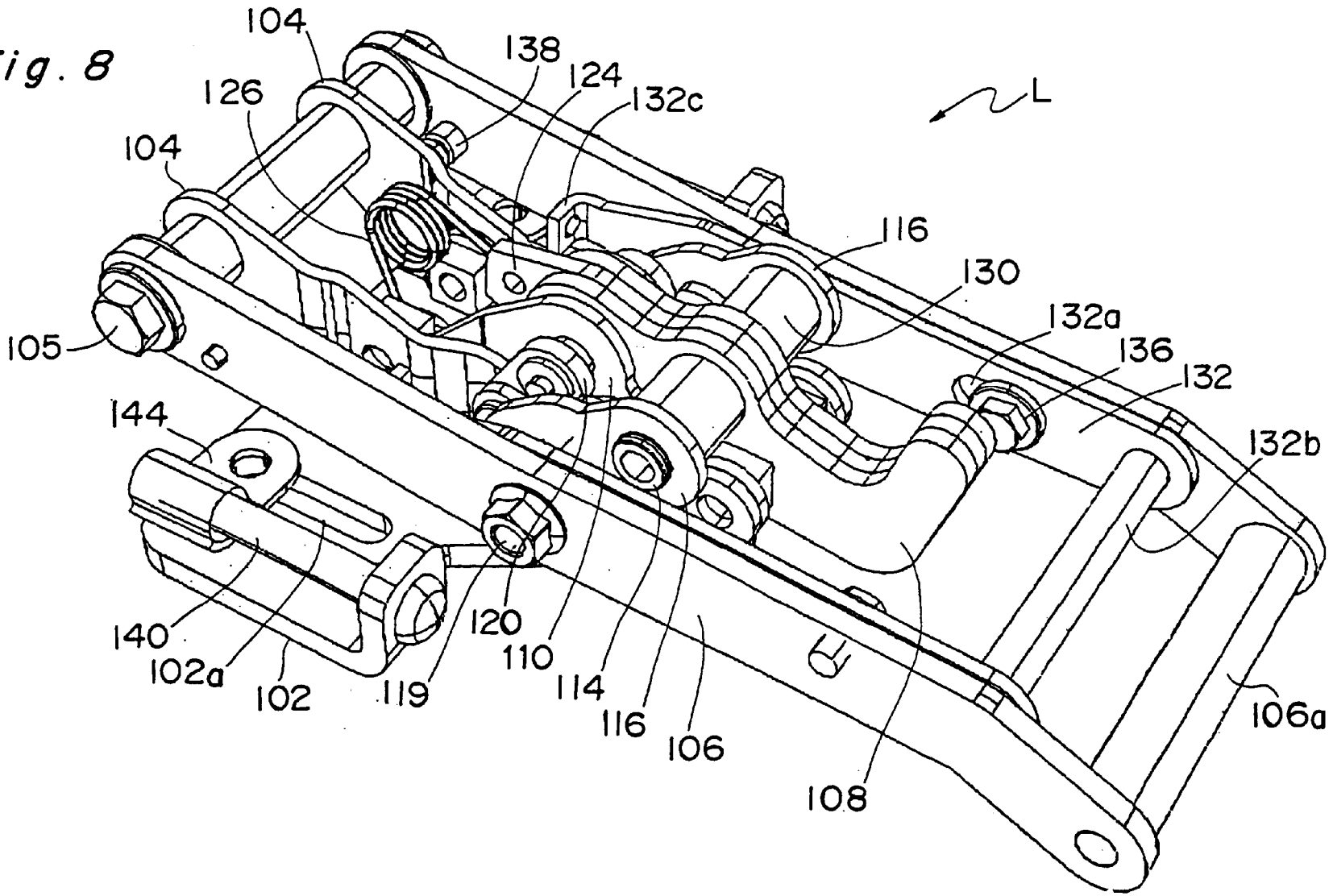
FIG. 8 is a perspective view of a locking device according to a second embodiment of the present invention under the lock-released condition.
Figure 9:
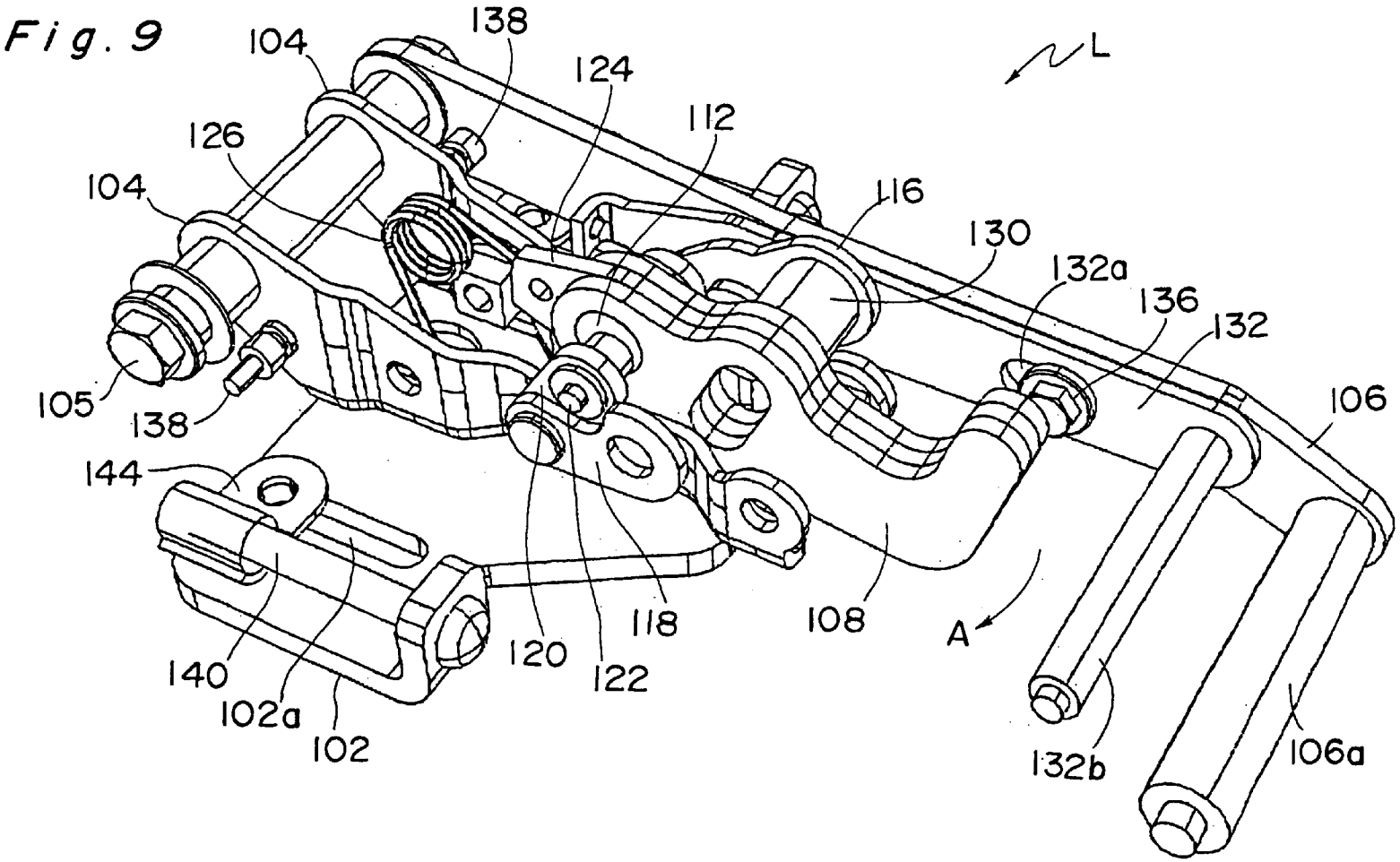
FIG. 9 is a partially cutaway perspective view of the locking device of FIG. 8.
Figure 10:
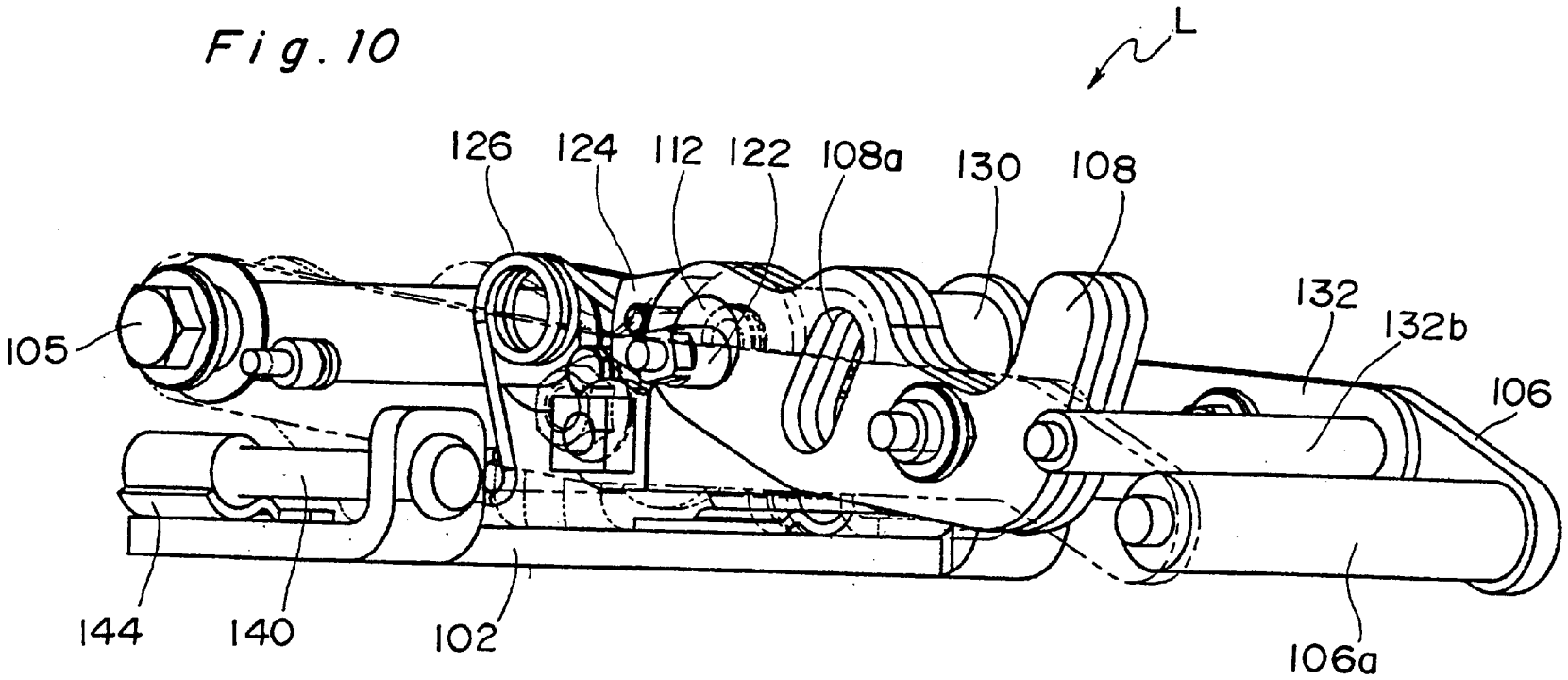
FIG. 10 is another partially cutaway perspective view of the locking device of FIG. 8.
Figure 11:
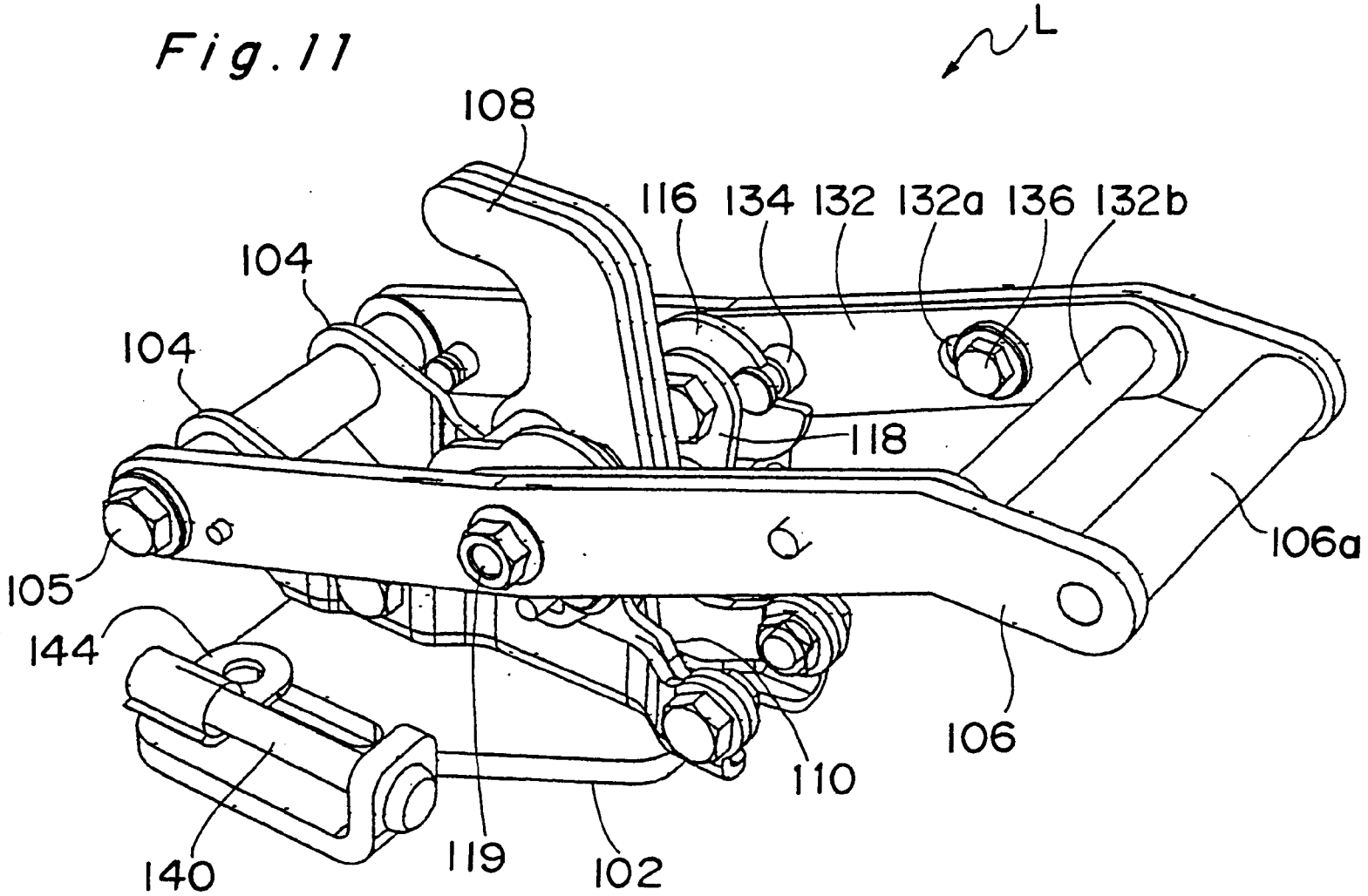
FIG. 11 is a perspective view of the locking device under the locked condition.
Figure 12:
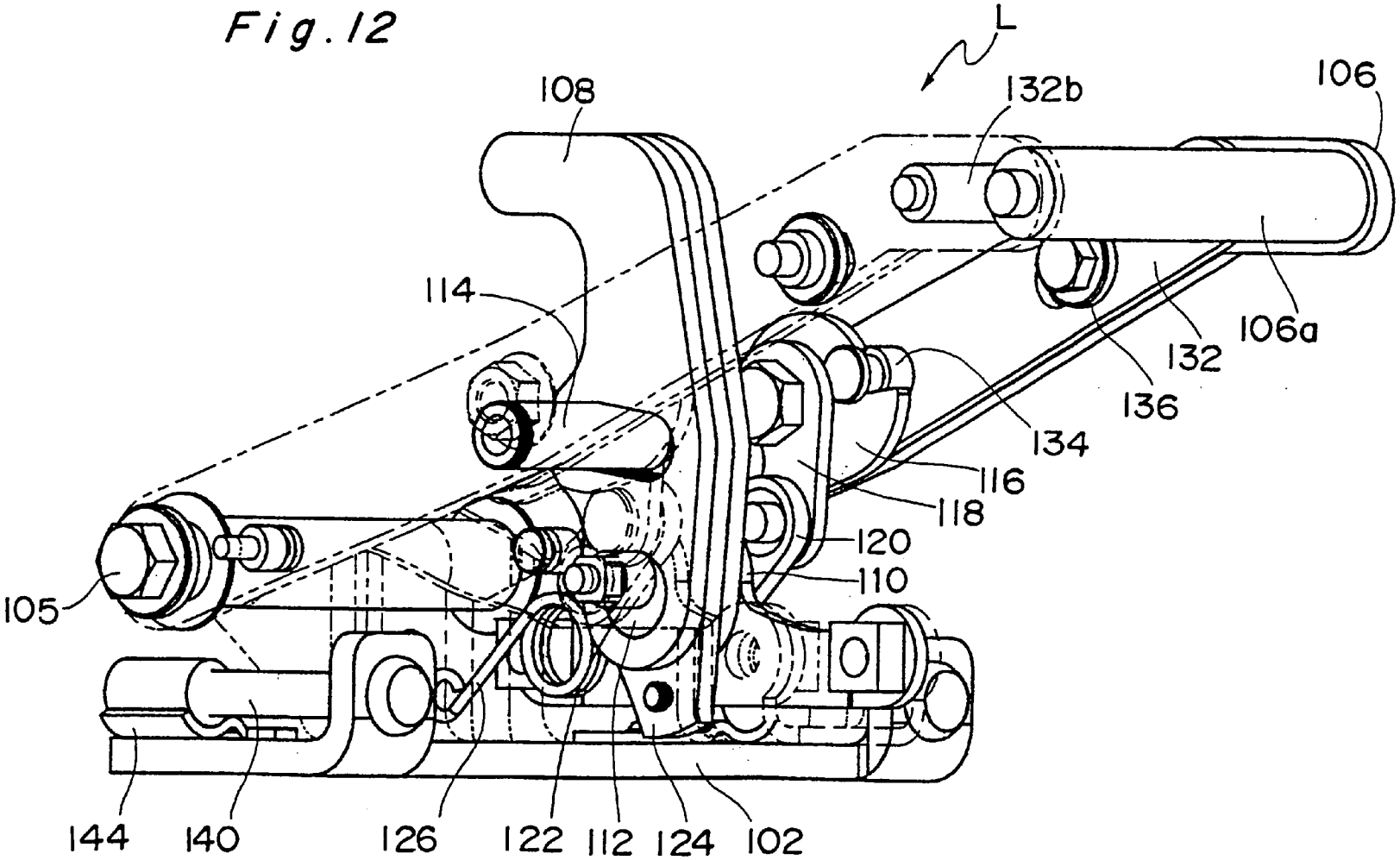
FIG. 12 is a partially cutaway perspective view of the locking device of FIG. 11.
Figure 13:
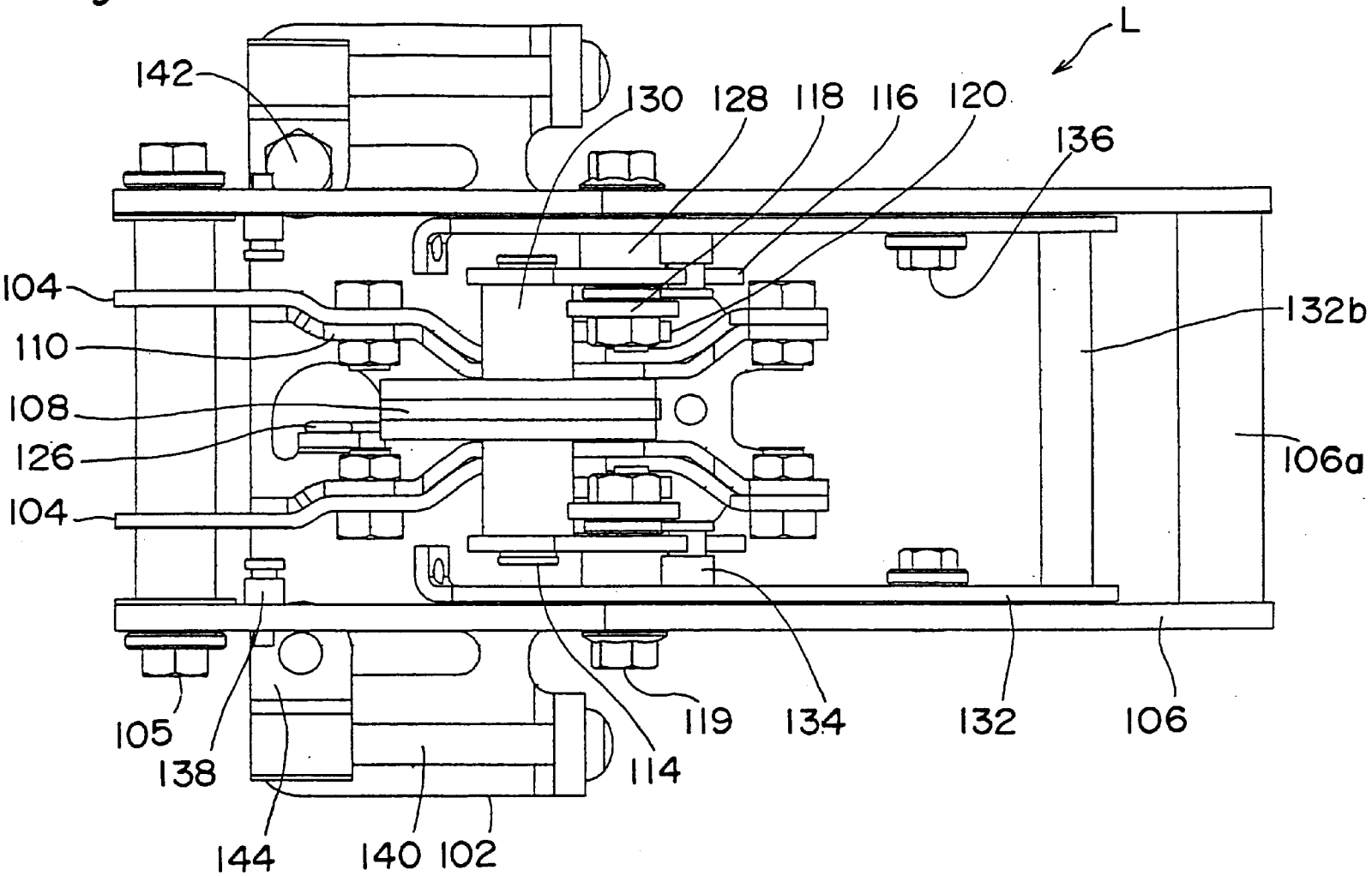
FIG. 13 is a top plan view of the locking device of FIG. 11.

Under the lock-released condition, the operating handle 106 is kept depressed together with the lock releasing handle 132, and the grip 132*a* of the lock releasing handle 132 is located at a position closest to the grip 106*a* of the operating handle 106, as shown in FIGS. 8 to 10. At this moment, the hook 108 is held substantially horizontally by the link mechanism including the first arms 116, 116 and the like, and the first arms 116, 116 are held in contact at side portions thereof with the locking pins 134, 134, respectively.

Furthermore, the center of rotation of the eccentric cam 112 (the center of the connecting shaft 122 (a in FIG. 15)) is positioned below the center of rotation of the hook 108 (the center of a round hole in which the eccentric cam 112 is loosely inserted (b in FIG. 15)). Because the locking shaft 114 is located on the upper side of the elongated opening 108*a* in the hook 108, the hook 108 is biased in the direction of the arrow A by means of the biasing force of the torsion spring 126 employed as an elastic member.

Figure 14:
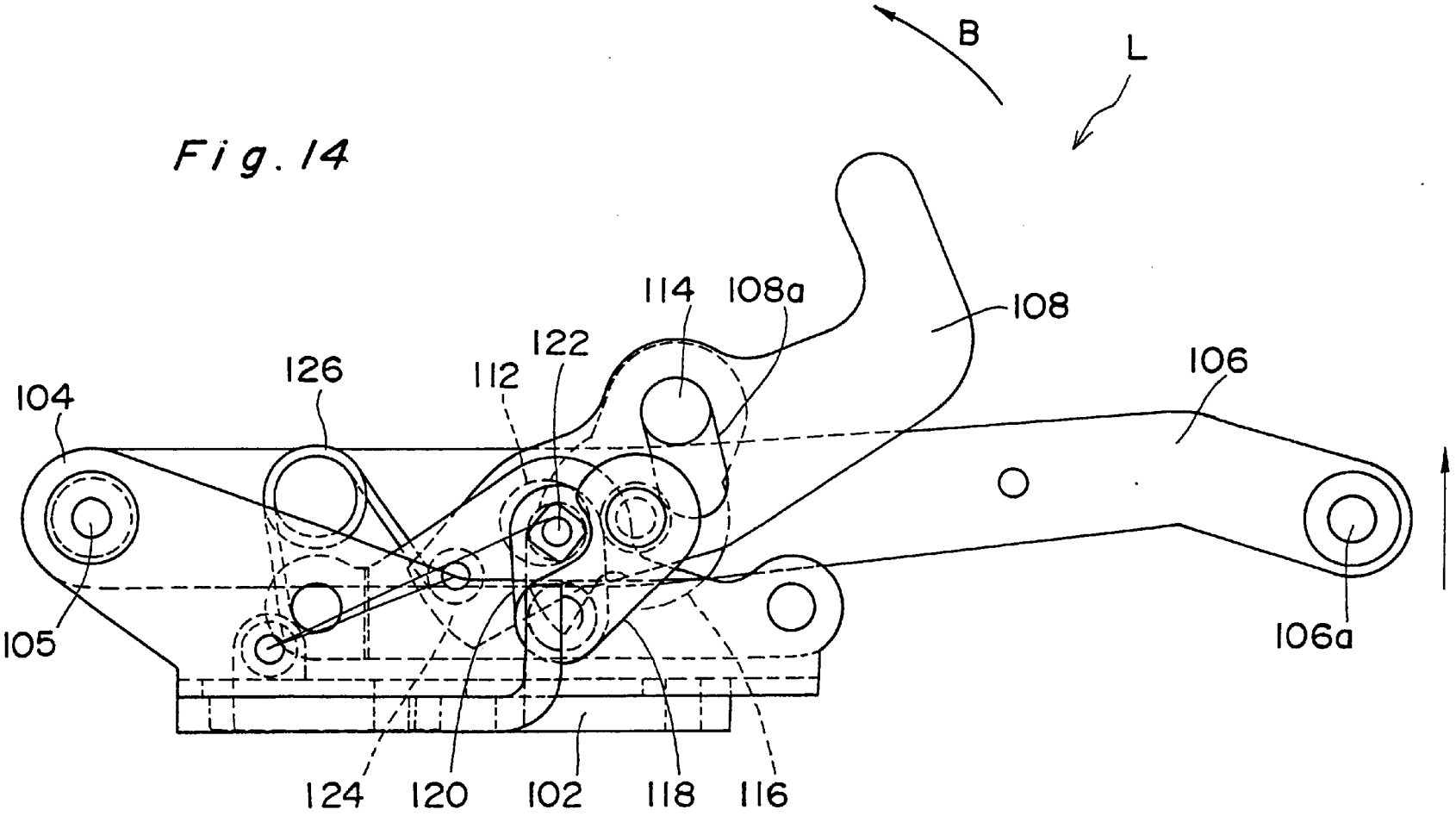
FIG. 14 is a partially cutaway side view of the locking device for explanation of the operation thereof.

When the stretcher is locked after the stretcher together with a sick or wounded person has been led in the ambulance and placed on the vibration isolator, the grip 106*a* of the operating handle 106 is lifted, as shown in FIG. 14. At this moment, the lock leasing handle 132 is lifted together with the operating handle 106, an d the locking shaft 114 loosely inserted in the hook 108 at an intermediate portion thereof is rotated in the direction of an arrow B, thus rotating the hook 108 towards the locking position (erected position).

FIG. 14 depicts the condition in which the hook 108 is located immediately before a change point. The elastic force of the torsion spring 126 acts on the center of rotation of the hook 108 at the change point. When the hook 108 is located on the lock releasing side (lower side) relative to the change point, the elastic force of the torsion spring 126 acts in the direction of the arrow A. On the other hand, when the hook 108 is located on the locking side (upper side) relative to the change point, the elastic force of the torsion spring 126 acts in the direction (direction of the arrow B) counter to the direction of the arrow A.

Accordingly, upon further lifting of the operating handle 106, when the hook 108 has passed the change point, the elastic force of the torsion spring 126 acts in the direction of the arrow B, as described above. In addition, because the locking shaft 114 is loosely inserted in the elongated opening 108*a* in the hook 108, the hook 108 is rapidly rotated in the direction of the arrow B and the distal end (locking portion) thereof is brought into contact with a portion of the stretcher. At this moment, the rocking shaft 114 is located on the side in the elongated opening 108*a* closer to the grip 106*a*.

Figure 15:
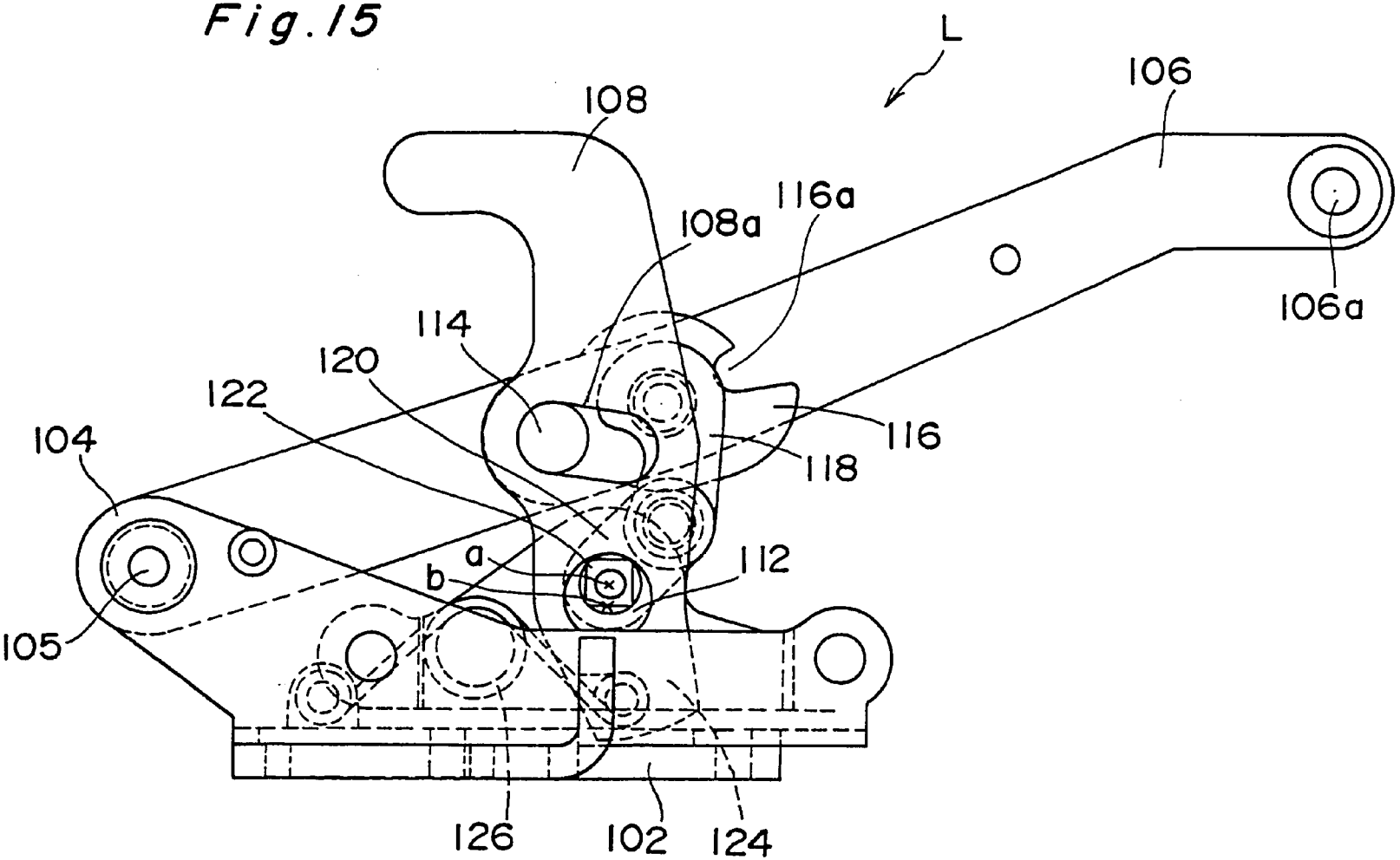
FIG. 15 is another partially cutaway side view of the locking device for explanation of the operation thereof.

Under such condition, when the operating handle 106 is further lifted, the locking shaft 114 is moved along the elongated opening 108*a* to the locking position shown in FIG. 15, and the locking pins 134, 134 are received in the recesses 116*a*, 116*a* of the first arms 116, 116 close to the mounting bolts 119, 119, respectively. At this moment, the lock releasing handle 132 is moved to and held at the position farthest from the grip 106*a* of the operating handle 106 by means of the biasing forces of the coil springs connected to the lower ends thereof.

While the operating handle 106 is moved from the lock-released position (the condition shown in FIGS. 8 to 10) to the locking position (the condition shown in FIGS. 11 to 13 or FIG. 15) by way of the condition shown in FIG. 14, the eccentric cam 112 is rotated substantially half via the second and third arms 118, 118, 120, 120. Accordingly, the center of rotation of the eccentric cam 112, which has been positioned below the center of rotation of the hook 108 at the lock-released position, is positioned above the center of rotation of the hook 108 at the locking position and, during locking, the hook 108 is gradually moved downwards by the action of the eccentric cam 112 to positively lock a portion of the stretcher. At the same time, the locking pins 134, 134 are received in the recesses 116*a*, 116*a* of the first arms 116, 116, respectively, thus preventing the hook from being released by, for example, vibration inputted from the outside.

When the hook of the stretcher is released, the grip 106*a* of the operating handle 106 and the grip 132*a* of the lock releasing handle 132 are both grasped to bring the grip 132*a* near the grip 106*a* against the biasing forces of the coil springs, thereby moving the locking pins 134, 134 apart from the associated recesses 116*a*, 116*a* of the first arms 116, 116. Thereafter, when the operating handle 106 together with the lock releasing handle 132 is moved downwards, the hook 108 is rotated about the eccentric cam 112 via the link mechanism until it reaches the lock-released position.

Because the above-described locking device L is attached to the vibration isolator by the fastening bolts 142, 142 loosely inserted in the elongated openings 102*a*, 102*a* in the frame 102, the longitudinal position of the locking device L relative to the vibration isolator can be properly adjusted by rotating the adjusting bolts 140, 140, making it possible to absorb variations in the vibration isolator and to positively lock the stretcher.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A locking device comprising:

a frame;

an operating handle rotatably mounted on said frame;

a link mechanism connected to said operating handle;

a hook connected to said operating handle via said link mechanism, said hook having a center of rotation and being operable to move between a locking position and a lock-released position; and an eccentric cam connected to said link mechanism and operable to move said center of rotation of said hook such that said center of rotation of said hook at the locking position is below said center of rotation of said hook at the lock-released position by rotation of said eccentric cam via said link mechanism.

2. The locking device according to claim 1, further comprising an elastic member connected to said hook, wherein an elastic force of said elastic member acts on said hook in a first direction when said hook is at the locking position, while the elastic force of said elastic member acts on said hook in a second direction counter to the first direction when said hook is at the lock-released position.

3. The locking device according to claim 1, further comprising a locking shaft connected to said operating handle via said link mechanism, wherein said hook has an elongated opening defined therein in which said locking shaft is loosely inserted.

4. The locking device according to claim 3, further comprising a locking pin slidable relative to said operating handle, wherein said link mechanism comprises an arm having a recess defined therein, and wherein said hook is locked by introducing said locking pin into said recess and is unlocked by moving said locking pin apart from said recess.

5. The locking device according to claim 4, further comprising a lock releasing handle slidable relative to said operating handle, wherein said locking pin is secured to said lock releasing handle.

6. The locking device according to claim 1, further comprising:

a lock releasing handle slidably connected to said operating handle; and an elastic member connected to said hook for biasing said hook.

7. The locking device of claim 6, wherein said lock releasing handle and said operating handle are arranged such that said lock releasing handle is operable to slide along a longitudinal direction of said operating handle.

8. The locking device of claim 6, wherein said locking pin is secured to said lock releasing handle.

9. The locking device of claim 8, wherein said lock releasing handle and said operating handle are arranged such that said lock releasing handle is operable to slide along a longitudinal direction of said operating handle.

10. The locking device of claim 1, further comprising a locking shaft connecting said hook and said link mechanism.

11. The locking device of claim 10, wherein said link mechanism comprises:

a first arm having a first end connected to said locking shaft and having a second end rotatably connected to said operating handle;

a second arm having a first end rotatably connected to said operating handle and having a second end;

a third arm having a first end rotatably connected to said second end of said second arm and having a second end connected to said eccentric cam.

12. A locking device comprising:

a frame;

an operating handle rotatably mounted on said frame;

an arm having a recess defined therein and having a first end and a second end opposite said first end, said first end of said arm being rotatably connected to said operating handle;

a hook rotatably connected to said second end of said arm; and a locking pin slidable relative to said operating handle such that said hook is locked by sliding said locking pin into said recess and is unlocked by sliding said locking pin out of said recess.

13. The locking device according to claim 12, wherein the locking device is mounted on a vibration isolator for a stretcher, and a position of the locking device can be adjusted in a direction longitudinally of said vibration isolator.

14. The locking device according to claim 12, further comprising a lock releasing handle slidable relative to said operating handle, wherein said locking pin is secured to said lock releasing handle.

15. The locking device according to claim 14, wherein said operating handle and said lock releasing handle have respective grips disposed adjacent and extending substantially parallel to each other.

16. The locking device according to claim 15, further comprising an elastic member for biasing said lock releasing handle, wherein said hook is locked by said elastic member that biases said lock releasing handle in a direction in which said grip of s aid lock releasing handle is moved away from said grip of said operating handle, while said hook is unlocked by moving said grip of said lock releasing handle towards said grip of said operating handle against an elastic force of said elastic member.

17. The locking device according to claim 12, further comprising:

a lock releasing handle slidably connected to said operating handle; and an elastic member connected to said lock releasing handle for biasing said lock releasing handle.

18. The locking device of claim 17, wherein said locking pin is secured to said lock releasing handle.

19. The locking device of claim 18, wherein said lock releasing handle and said operating handle are arranged such that said lock releasing handle is operable to slide along a longitudinal direction of said operating handle.

20. The locking device of claim 17, wherein said lock releasing handle and said operating handle are arranged such that said lock releasing handle is operable to slide along a longitudinal direction of said operating handle.

* * * * *